US006254346B1

(12) United States Patent
Fukuno et al.

(10) Patent No.: US 6,254,346 B1
(45) **Date of Patent: *Jul. 3, 2001**

(54) GAS TURBINE COOLING MOVING BLADE

(75) Inventors: Hiroki Fukuno; Yasuoki Tomita; Kiyoshi Suenaga, all of Takasago (JP)

(73) Assignee: Mitsubishi Heavy Industries, Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/046,865

(22) Filed: Mar. 24, 1998

(30) Foreign Application Priority Data

Mar. 25, 1997 (JP) ..... 9-071860

(51) Int. Cl.[7] ..... F01D 5/18
(52) U.S. Cl. ..... 416/97 R; 416/96 R; 415/115
(58) Field of Search ..... 416/97 R, 97 A, 416/96 R, 95; 415/115

(56) References Cited

U.S. PATENT DOCUMENTS

| | | | | |
|---|---|---|---|---|
| 3,527,544 | | 9/1970 | Allen . | |
| 3,806,274 | * | 4/1974 | Moore | 416/97 R |
| 4,127,358 | * | 11/1978 | Parkes | 416/97 R |
| 4,390,320 | | 6/1983 | Eiswerth | 416/97 R |
| 4,940,388 | | 7/1990 | Lilleker et al. | 416/97 R |
| 5,232,343 | | 8/1993 | Butts | 416/97 R |
| 5,468,125 | | 11/1995 | Okpara et al. | 416/97 R |
| 5,482,435 | * | 1/1996 | Dorris et al. | 416/97 R |
| 5,536,143 | * | 7/1996 | Jacala et al. | 416/97 R |
| 5,785,496 | * | 7/1998 | Tomita | 416/97 R |

FOREIGN PATENT DOCUMENTS

| | | |
|---|---|---|
| 2 260 944 | 6/1973 | (DE) . |
| 32 48 162 | 7/1983 | (DE) . |
| 1131713 | 10/1968 | (GB) . |

* cited by examiner

*Primary Examiner*—F. Daniel Lopez
*Assistant Examiner*—Richard Woo
(74) *Attorney, Agent, or Firm*—Alston & Bird LLP

(57) ABSTRACT

The present invention relates to a gas turbine cooling moving blade and is applied to a large-sized blade for a high temperature so as to reduce its thickness and increase cooling efficiency and easily process the moving blade. A cavity is formed in the interior of the moving blade from the root portion to a shroud at the tip of the moving blade. Many turbulators are arranged in parallel with each other on an inner wall face of the moving blade. Cooling air from a turbine rotor enters the cavity formed within the moving blade from a cooling air inlet. This cooling air is dispersed and disturbed by the turbulators so that heat transfer is improved. Accordingly, the moving blade is efficiently cooled by the cooling air in comparison with a conventional cooling system having a multiplicity of holes. The cooling air is then discharged out of a cooling air outlet through air cooling holes of the shroud located at the tip of the moving blade. Accordingly, the proportion of the hollow space within the moving blade is increased by the cavity and the moving blade is made light in weight. The moving blade is more easily processed and the cooling efficiency of the moving blade is increased.

2 Claims, 3 Drawing Sheets

GAS TURBINE COOLING MOVING BLADE

FIELD OF THE INVENTION AND RELATED ART STATEMENT

The present invention relates to a gas turbine cooling moving blade whose thickness is small and which has a cavity therein, and it is particularly applicable to a large-sized blade used in a rear stage of a gas turbine.

Recently, the gas turbine has been used at a higher temperature and the output of the gas turbine has been increased. Accordingly, a moving blade also tends to be large-sized. In particular, the moving blade used in a rear stage has become particularly large. For example, moving blades having a size from 50 to 60 cm have appeared. In such a large-sized moving blade, the weight of the moving blade itself increases and vibrations of the moving blade also increase so that stress generated by centrifugal force driving the rotation of the moving blade is greatly increased in comparison with conventional blades. Accordingly, in such moving blades, the thickness of a blade section is reduced as much as possible so as to make the moving blade light in weight. Further, the moving blade has a smaller width toward the blade tip by making the moving blade tapered.

FIG. 5 shows one example of the above-mentioned large-sized conventional moving blade. FIG. 5(A) is a longitudinal sectional view of a central portion of this moving blade. FIG. 5(B) is a cross-sectional view taken along line C—C in FIG. 5(A). In FIG. 5(A), reference numerals 10, 11 and 12 respectively designate an entire moving blade, a hub portion and a blade portion. Reference numerals 13 and 14 respectively designate a cavity and a supporting rib within the cavity 13. This supporting rib 14 is arranged to support a ceramic core used as a core for forming the cavity 13 at the time of casting and also has a reinforcing function.

As shown in FIG. 5(B), many multiholes 15 within the blade 12 are bored toward a blade tip 16. A shroud 17 is attached to the tip of the blade 12. The blade base portion 18 occupies about 25% of axial length of the blade from the hub portion 11 to the blade tip. The cavity 13 is formed within the blade base portion 18. A blade root portion 19, together with the above-mentioned parts, forms the large-sized moving blade 10.

In the moving blade of the above construction, when cooling air 20 is sent from an unillustrated turbine rotor, this cooling air 20 enters the cavity 13 and cools the entire moving blade 10 while the cooling air passes through the multiholes 15. The cooling air is then discharged from an unillustrated opening formed in the blade tip 16 or the shroud 17 to a combustion gas passage.

However, in such a moving blade 10 having a cooling structure therein, it is difficult to manufacture a casting core for forming the cavity 13 at the time of manufacture and it is difficult to place a casting core within the moving blade 10 having the cavity 13.

Further, since temperature and pressure are still increasing to improve efficiency of the gas turbine, the cooling of the moving blade 10 used in the gas turbine approximately having a turbine inlet temperature of 1500° C. becomes insufficient when the cavity 13 is simply formed in the above-mentioned blade base portion 18 and the cooling air 20 is introduced into the multiholes 15 within the moving blade 10. The lack of sufficient cooling may cause reduced creep strength in this moving blade 10.

Furthermore, when the cooling is done using only the multiholes 15 and the cooling air 20 merely passes through the multiholes 15, cooling efficiency cannot be further improved. In addition, hollow space in the blade cannot be increased to make the moving blade light in weight, and a boring process is required in manufacturing the blade.

Therefore, there is room for some consideration so as to make the processing easier.

OBJECT AND SUMMARY OF THE INVENTION

Therefore, to solve some of the problems associated with the conventional large-sized thin moving blade of the gas turbine, an object of the present invention is to provide a moving blade which can easily be processed without the conventional working process of multiholes and which has reduced weight to increase the proportion of hollow space in the blade and which is also applicable to a gas turbine having a higher inlet temperature by increasing further cooling efficiency in comparison with the blades having multiholes.

The present invention provides the following (1) and (2) means to achieve the above object.

(1) A cavity is formed in the entire interior of a moving blade from the blade root portion to the tip of the moving blade, and a plurality of turbulators are formed on an inner wall of this cavity.

(2) In a cooling moving blade of a gas turbine, a shroud is arranged at the tip of the moving blade and a passage for cooling air is formed from the blade root portion to the shroud, and the moving blade and the shroud are cooled by the cooling air flowing through this passage and by discharging the cooling air from the shroud. This passage for cooling air is formed by a cavity disposed in the interior of the moving blade from the blade root portion to the tip of the moving blade, and a plurality of turbulators are formed on an inner wall of the cavity.

In the gas turbine cooling moving blade of each of the above (1) and (2) according to the present invention, the cavity is formed in the interior of the moving blade from the blade root portion to the tip of the moving blade, and many turbulators are formed. Accordingly, a flow of the cooling air is disturbed by the turbulators as the cooling air flows into the cavity from the blade root portion and rises within the moving blade. Therefore, the frequency of the cooling air hitting the inner wall of the moving blade is increased so that the heat transfer rate is improved. Accordingly, cooling efficiency is improved in comparison with the cooling of a conventional multihole system. The cooled air is externally discharged from the tip portion of the moving blade. In the invention of the above (2), the cooled air is externally discharged from the shroud.

In accordance with the cooling moving blade of the gas turbine in each of the above (1) and (2) of the present invention, no conventional boring process of multiholes is required, and only the cavity and the turbulators need to be formed so that the moving blade is more easily manufactured. Since the moving blade becomes lighter due to a larger hollow space in the blade, low frequency vibrations are reduced and a bad influence of vibrational stress caused by centrifugal force is reduced.

As explained above, in the present invention, (1) a cavity is formed in the entire interior of the moving blade from the blade root portion to the tip of the moving blade, and a plurality of turbulators are formed on the inner wall of this cavity. Further, (2) in a cooling moving blade of a gas turbine, a shroud is arranged at the tip of the moving blade, and a passage for cooling air is formed from a blade root portion to the shroud, and the moving blade and the shroud are cooled by the cooling air flowing through this passage and by discharging the cooling air from the shroud. This passage for cooling air is formed by a cavity formed in the interior of the moving blade from said blade root portion to the end tip of the moving blade, and the turbulators are formed around an inner wall of the cavity. Accordingly, a flow of the cooling air flowing into the cavity is disturbed by the turbulators so that heat transfer becomes preferable and cooling efficiency is improved in comparison with cooling using the conventional multiholes.

Further, there is no such machining working process as boring of the multiholes, etc., so that the moving blade is manufactured easily. Since the cavity is formed, the proportion of hollow space in the blade increases. With this, the moving blade becomes lighter in weight and an influence of vibrations caused by centrifugal force is reduced. Thus, the moving blade of the high temperature gas turbine can be made thin and light in weight without difficulties.

BRIEF DESCRIPTION OF THE DRAWINGS

FIG. 5 shows a conventional gas turbine cooling moving blade in which

DETAILED DESCRIPTION OF PREFERRED EMBODIMENTS

Figure 1:
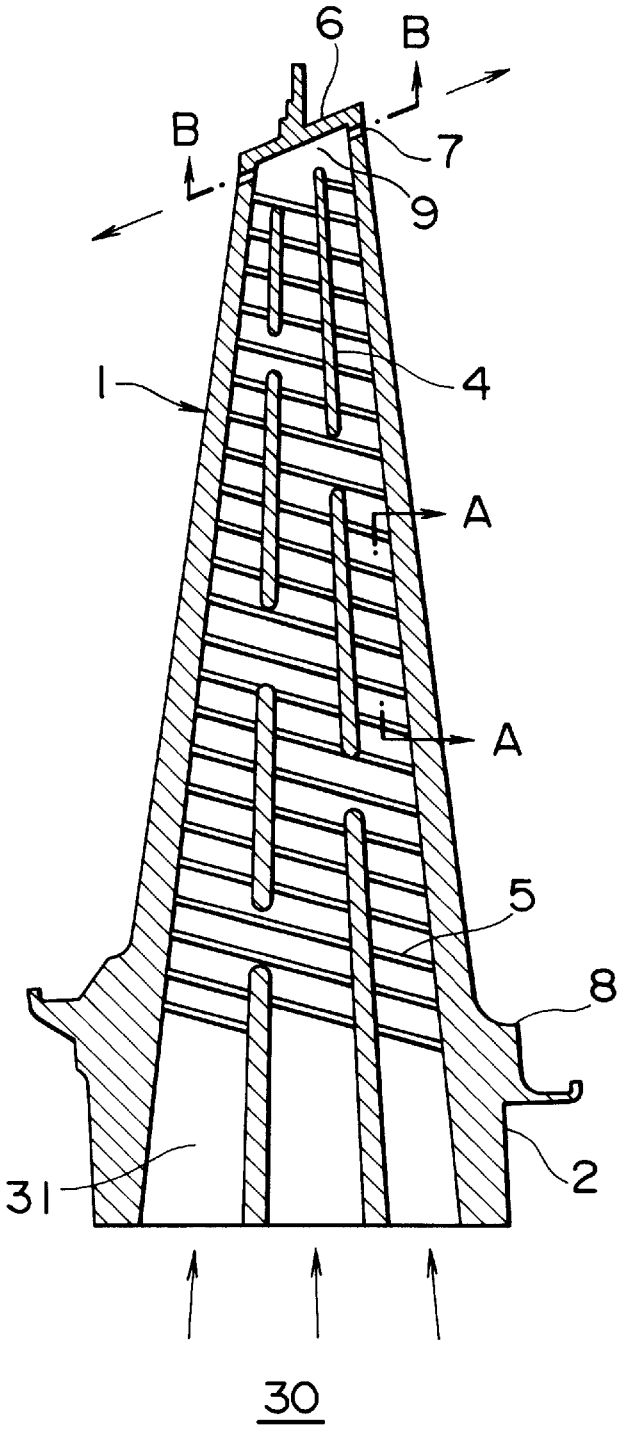
FIG. 1 is a cross-sectional view of a central portion of a gas turbine cooling moving blade in accordance with one embodiment of the present invention.
Figure 2:
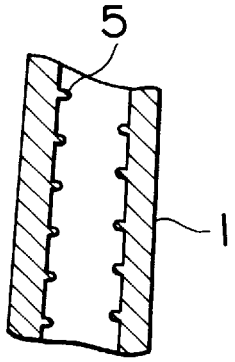
FIG. 2 is a view taken along arrow line A—A in FIG. 1.
Figure 3:
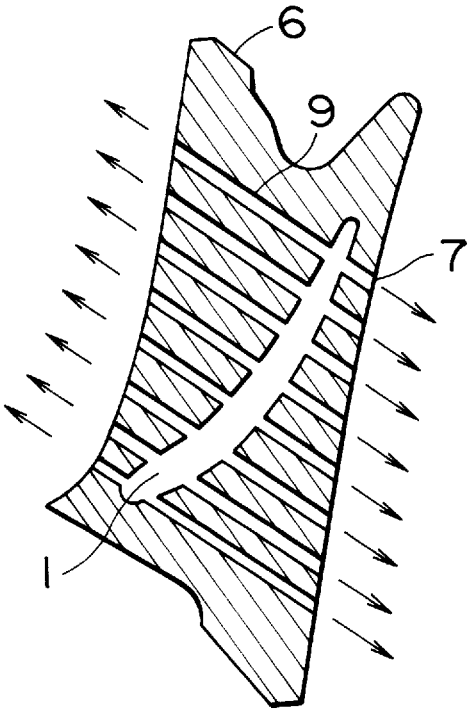
FIG. 3 is a view taken along arrow line B—B in FIG. 1.
Figure 4:
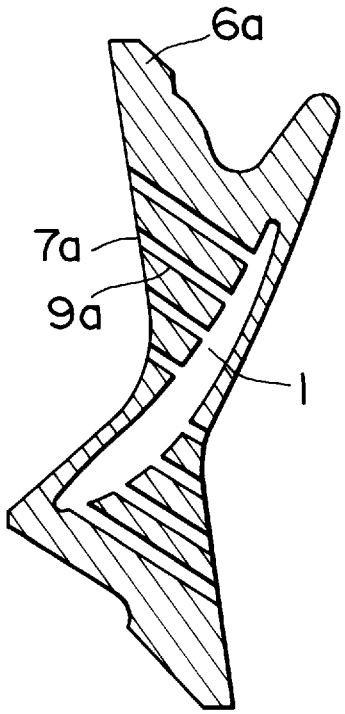
FIG. 4 is a view of a shroud shown as a modified example in FIG. 3.
Figure 5A:
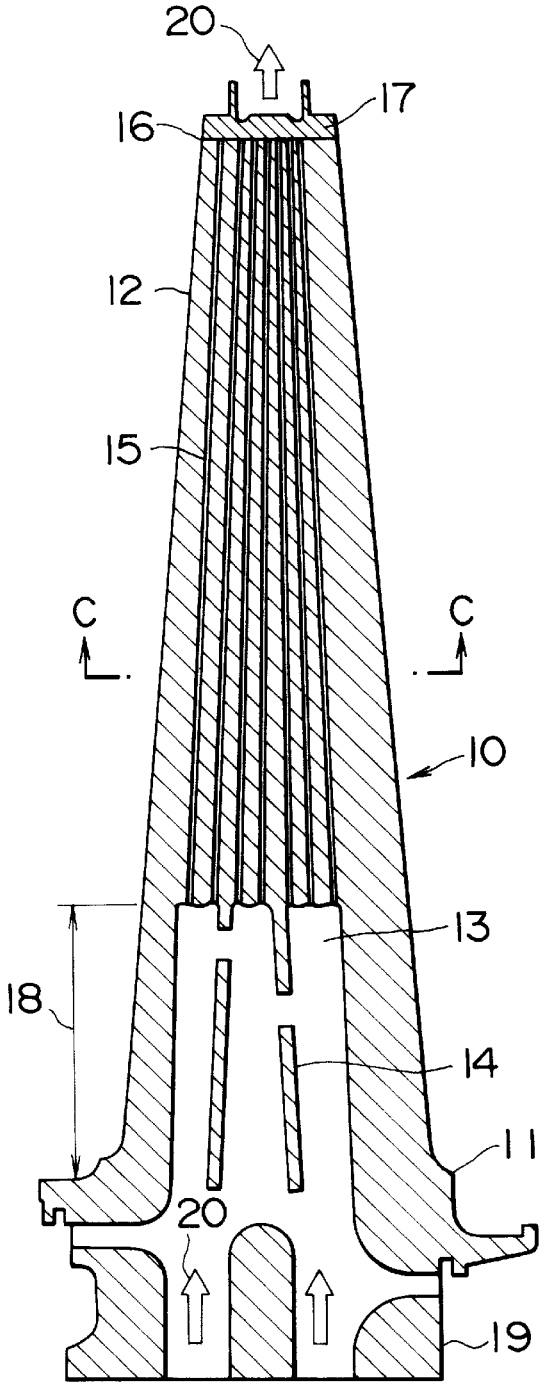
FIG. 5A RELATED ART
FIG. 5(A) is a cross-sectional view of a central portion of the conventional gas turbine cooling moving blade and FIG. 5(B) is a cross-sectional view taken along line C—C of FIG. 5(A).
Figure 5B:
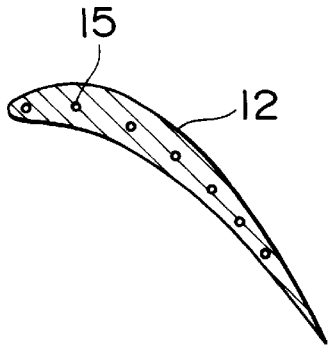
FIG. 5B RELATED ART

The embodiments of the present invention will next be described with reference to the drawings. FIG. 1 is a cross-sectional view of a central portion of a gas turbine cooling moving blade in accordance with one embodiment of the present invention. FIG. 2 is a view taken along arrow line A—A in FIG. 1. FIG. 3 is a view taken along arrow line B—B in FIG. 1. FIG. 4 is a view taken along arrow line B—B and showing a modified example of a blade structure shown in FIG. 3.

In FIG. 1, the moving blade 1 includes a blade root portion 2. A cavity 31 is formed within this moving blade 1 and is communicated from the blade root portion 2 to a tip of the moving blade 1. A core supporting rib 4 supports the core with the internal cavity 31. As shown in FIG. 2, many turbulators 5 are formed on an inner wall of the cavity 31. They are inclined with respect to the axis of the moving blade and are arranged in parallel with each other. The turbulators can take, in fact, any shape as long as they can disturb the flow of cooling air to a varying extent. In this embodiment they are shown as linear projections of certain width. A shroud 6 is arranged at the tip of the moving blade 1. An air cooling hole 9 and a cooling air outlet 7 are communicated with the cavity 31 around this shroud 6. Reference numeral 8 designates a hub portion of an upper portion of the blade root portion 2.

FIG. 3 is a view taken along arrow line B—B in FIG. 1 and showing the interior of the shroud. As shown in FIG. 3, many shroud air cooling holes 9 communicated with the cavity 31 in a blade tip portion are formed in parallel with each other between the front and trailing edges of the shroud. Each of the shroud air cooling holes 9 is externally opened from the cooling air outlet 7. Accordingly, the moving blade has a structure capable of externally discharging cooling air.

FIG. 4 shows another modified example of the shroud. The shroud 6*a* is deformed and has a narrowed central portion to make this shroud light in weight. Similarly, many shroud air cooling holes 9*a* are formed in parallel with each other so as to provide a structure capable of externally discharging the cooling air from the cooling air outlet 7*a*.

In the shroud 6*a* shown in FIG. 4, the weight of a blade tip which is greatly influenced by centrifugal forces is reduced so that vibrations of the blade tip can be restrained, which advantageously provides more vibrational strength of the moving blade.

In the moving blade 1 having the above construction, the cooling air from an unillustrated turbine rotor enters the blade root portion 2 from a cooling air inlet 30 and is transmitted through the cavity 31. A flow of this cooling air is disturbed within the cavity 31 by many turbulators 5 formed on the inner wall of the moving blade 1 so that contact of this flow and the blade inner wall is increased. Therefore, heat transfer is improved and cooling effects are enhanced, while the cooling air flows from the cooling air outlet 7 to the exterior of the moving blade 1 through the air cooling holes 9 of the shroud 6 at the tip of the moving blade.

In accordance with the embodiment explained above, the cavity 31 is formed in the interior of the blade 1 from the root portion 2 of the moving blade 1 to the blade tip, and the turbulators 5 are formed on the inner wall of the blade. Accordingly, the moving blade can be more easily manufactured in comparison with the conventional structure having multiholes 15. Further, the proportion of hollow space in the moving blade increases, and the moving blade can be lighter in weight. The cooling efficiency of the moving blade is also greatly improved in comparison with the one with multiholes 15 since heat transfer is improved by actions of the internal turbulators 5.

Further, since the moving blade 1 has a hollow shape with the cavity 31 and is lighter in weight, low frequency vibrations are reduced and vibrational characteristics are improved so that an influence of the vibrations of the moving blade on strength can be reduced. Further, since no boring process, etc. are required in manufacture of the moving blade 1, the degree of freedom in design is increased and the moving blade used in a high temperature gas turbine can have a reduced thickness.

What is claimed is:

1. A cooled gas turbine moving blade comprising:

a cavity formed in the blade said cavity extending from a blade root portion to a tip end portion of the blade, a plurality of elongate turbulators formed on an inner wall of the cavity, said turbulators being arranged in parallel to each other and transverse to the blade axis that extends from the blade root portion to the tip end, and a casting core supporting rib formed in the cavity;

a shroud provided on the tip end portion of the blade and having a plurality of parallel air cooling passages communicating with the cavity in the blade, each having an opening for discharging air therefrom;

said moving blade being cooled by cooling air flowing from the blade root portion through said cavity in said blade and said passages in said shroud and discharged from said openings in said shroud.

2. A gas turbine cooling blade according to claim 1, wherein said shroud has a narrowed central portion located between a leading edge and a trailing edge potion thereof.

* * * * *